US006471739B2

(12) United States Patent
Eom

(10) Patent No.: US 6,471,739 B2
(45) Date of Patent: Oct. 29, 2002

(54) DEHUMIDIFIER HOUSING

(75) Inventor: Nam Seob Eom, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/727,687

(22) Filed: Dec. 4, 2000

(65) Prior Publication Data

US 2001/0037630 A1 Nov. 8, 2001

(30) Foreign Application Priority Data

Dec. 2, 1999 (KR) ..... 99-54575
Sep. 7, 2000 (KR) ..... 2000-53169

(51) Int. Cl.[7] ..... B01D 53/26

(52) U.S. Cl. ..... 55/471; 55/472; 55/473; 96/119; 96/120; 96/144

(58) Field of Search ..... 55/356, 357, 471, 55/472, 473, 496; 261/DIG. 65; 96/119, 120, 144, 146, 150; 95/110, 113, 126

(56) References Cited

U.S. PATENT DOCUMENTS 3,594,990 A * 7/1971 Hawley ..... 96/115
3,866,333 A * 2/1975 Sarukahanian et al. ..... 96/325
4,712,382 A * 12/1987 LeClear ..... 96/405
4,927,436 A * 5/1990 Glienke ..... 96/119
5,089,035 A * 2/1992 Kaneko ..... 96/120
5,230,719 A * 7/1993 Berner et al. ..... 96/144
5,478,379 A * 12/1995 Bevins ..... 55/356
5,843,213 A * 12/1998 Fujimura ..... 96/144

* cited by examiner

*Primary Examiner*—David A. Simmons
*Assistant Examiner*—Minh-Chau T. Pham
(74) *Attorney, Agent, or Firm*—Birch, Stewart, Kolasch & Birch, LLP

(57) ABSTRACT

Dehumidifier housing including a lower housing having a barrier part fitted vertically between a compressor and a water tank inside of a cabinet, a drain part formed in a horizontal direction above the barrier part for collecting condensate dehumidified at a heat exchanger and draining the water tank, and sidewalls formed at both sides of the barrier part and the drain part in a front and rear direction and supported on an inside of the cabinet, an upper housing having an orifice part with an air flow hole in a central portion, and a rim part around the orifice part in front and rear direction and supported on an inside of the cabinet, and coupling means for coupling the lower housing and the upper housing, thereby enhancing rigidity and dehumidifying effect.

16 Claims, 10 Drawing Sheets

DEHUMIDIFIER HOUSING

BACKGROUND OF THE INVENTION

1. Field of the Invention

The present invention relates to a dehumidifier for removal of humidity in a room, and more particularly, to a dehumidifier housing which supports a heat exchanger and a fan.

2. Background of the Related Art

FIG. 1 illustrates a perspective disassembled view of a dehumidifier having a related art housing structure, referring to which the related art dehumidifier will be explained.

There is a filter 54 behind a case 51 in a body of the dehumidifier 50, a heat exchanger 60 in front of the filter 54 for carrying out a dehumidifying action, and a fan 70 in front of the heat exchanger 60. That is, the room air flows from the rear of the dehumidifier, is dehumidified at the heat exchanger 60, and is discharged into a room through a discharge grill 9 in front of the dehumidifier. The heat exchanger 60 is provided with an evaporator and a condenser, refrigerant is circulated by a compressor 53, and water dehumidified at the condenser (hereafter called as "condensate") is collected at a water tank 80 under the heat exchanger 60.

Configuration of the compressor 53, the heat exchanger 60, and the fan 70 in the related art dehumidifier will be explained in detail.

The compressor 53 is mounted on a lower panel 52 which forms a bottom of the case 51, and the heat exchanger 60 is fitted over a drain pan 61 having a water discharge groove 62 for guiding downward flow of the condensate. The fan 70 is fixed to a shroud 72 having a central air flow hole 73 by a motor mount 75. The water tank 80 is placed inside of a barrier 85 bent to a rear direction (in a direction the filter is fitted). The drain pan 61 is formed of a plate for stable mounting of the heat exchanger 60 thereon, with a water groove 62 for making the condensate formed during the dehumidification process to flow to the water tank 80 under the drain pan 61. The drain pan 61 has projections on both sides thereof for insertion in insertion grooves 81 in both sides of the water base.

In the meantime, the shroud 72 is fixed to an upper side of the drain pan 61 in a vertical direction, has an air flow hole 73 for flow of air by the fan 70. And, the motor mount 75 is fitted to cross the air flow hole 73 in the shroud 72, with both ends thereof fastened to a front side of the shroud 72 by using screws through a plurality of screw holes 76. That is, the motor mount 75 fastens the fan 70 to the shroud 72. In detail, at first the fan 70 is placed on an inside surface of the shroud 72, with the screw holes in the flange 71 of the fan 70 matched with the screw holes 76 in the motor mount 75, and screws are fastened therethrough, to fix the fan 70 to the shroud 72. In the meantime, the barrier 85, having both ends bent backward, is fitted to the lower panel 52, and the shroud 72 and the drain pan 61 are fitted to an upper portion of the barrier 85. And, the water tank 80 is placed inside of the barrier 85 for collecting the condensate flowing along the water groove 62 in the drain pan 61.

However, the related art dehumidifier has the following problems.

First, the related art dehumidifier has the drain pan 61, the shroud 72, the motor mount 75 and the barrier 85 provided individually for supporting the heat exchanger 60 and the fan 70. This results poor productivity during assembly of the dehumidifier as many components are required to be assembled.

Second, the mounting of heavy components, such as the heat exchanger 60 and the fan 70, on an assembly of a plurality of components renders a poor rigidity and deformation of the components. Finally, the transmission of vibration from the heat exchanger 60 and the fan 70 to the components deteriorates fastening forces between the components, and causes noise and trouble as the components come apart.

SUMMARY OF THE INVENTION

Accordingly, the present invention is directed to a dehumidifier housing that substantially obviates one or more of the problems due to limitations and disadvantages of the related art.

An object of the present invention is to provide a dehumidifier housing which can enhance a productivity in assembly of the dehumidifier.

Another object of the present invention is to provide a dehumidifier housing which can improve dehumidifier performance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dehumidifier housing includes a lower housing having a barrier part fitted vertically between a compressor and a water tank inside of a cabinet, and a drain part formed on an upper portion of the barrier part in a horizontal direction for collecting condensate dropped from a heat exchanger and draining to the water tank, and an upper housing having a shroud part extended from the upper portion of the barrier part a vertical direction with an air flow hole at a central portion for mounting a fan, and a motor fixing part projected from the air flow hole in the shroud part in a radial form for fixing a motor of the fan thereto, wherein the upper housing and the lower housing are formed as one unit.

The barrier part further includes a main wall part fitted vertically between the compressor and the water tank, and sidewalls extended from both sides of the main wall to both sides of the drain part.

In other aspect of the present invention, there is provided a dehumidifier housing including a lower housing having a barrier part fitted vertically between a compressor and a water tank inside of a cabinet, a drain part formed in a horizontal direction above the barrier part for collecting condensate dehumidified at a heat exchanger and draining the water tank, and sidewalls formed at both sides of the barrier part and the drain part in a front and rear direction and supported on an inside of the cabinet, an upper housing having an orifice part with an air flow hole in a central portion, and a rim part around the orifice part in front and rear direction and supported on an inside of the cabinet, and coupling means for coupling the lower housing and the upper housing.

The upper housing further includes guide parts projected from an inside of the rim part toward the heat exchanger for guiding flow of dehumidifying air passed through the heat exchanger.

The coupling means includes a setting part formed recessed at an upper portion of sidewalls of the lower housing, and a barrier assembly part extended from a bottom of he rim part of the upper housing. And, the guide part of the upper housing includes a downward guide extension below the guide part, and the drain part of the lower housing includes a guide insertion part for inserting the guide extension thereto.

There is a turbo fan mounted in the air flow hole in the upper housing. And, there is an annular guide around the air flow hole of the orifice part projected toward the heat exchanger for guiding air flow toward the turbo fan.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
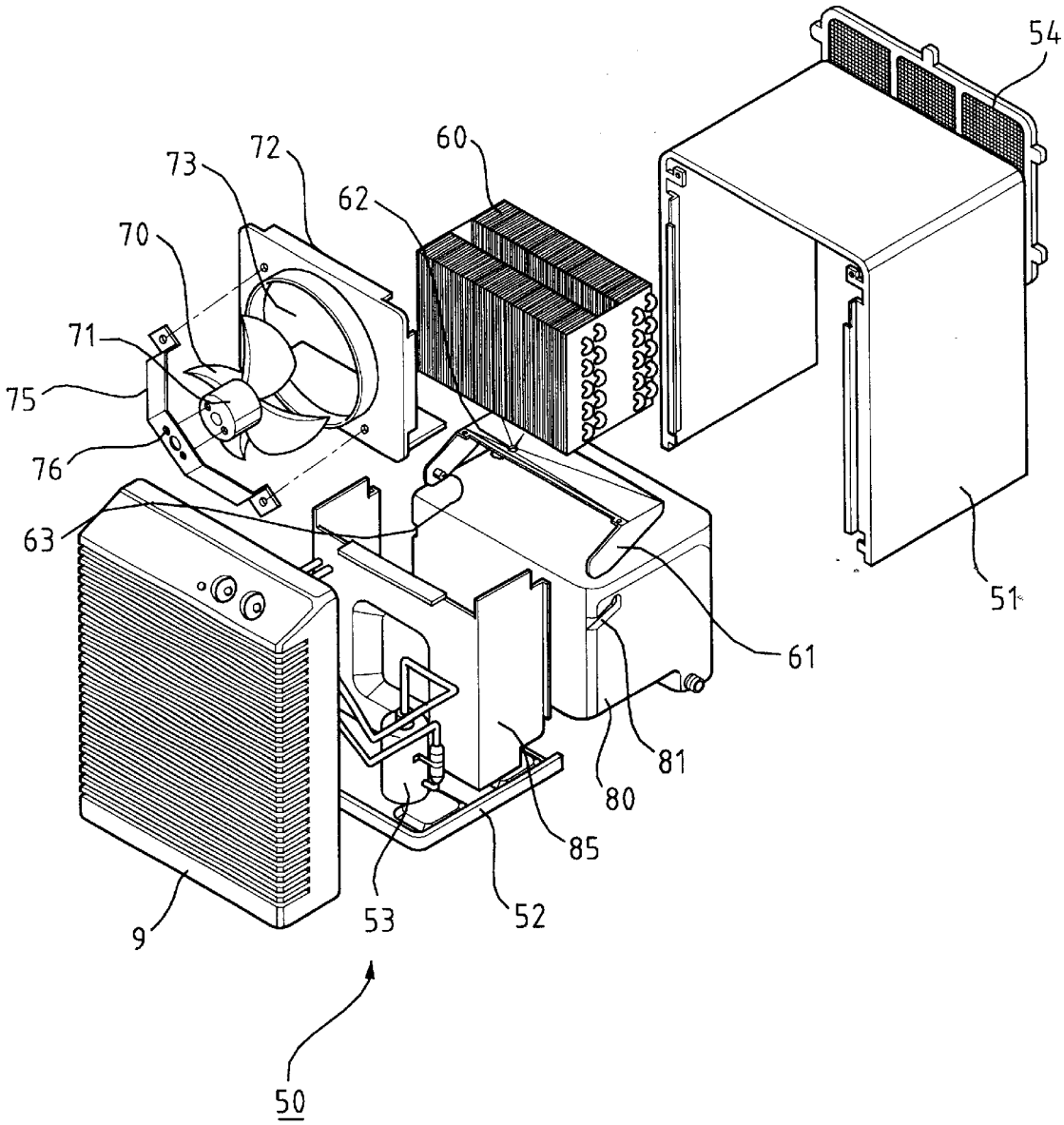
FIG. 1 RELATED ART
FIG. 1 illustrates a perspective disassembled view of a related art dehumidifier.

Reference will now be made in detail to the preferred embodiments of the present invention, examples of which are illustrated in the accompanying drawings. A first preferred embodiment of the present invention will be explained with reference to FIGS. 2~6.

Basically, the dehumidifier of the present invention also includes a compressor 2, a heat exchanger 3 having an evaporator 3*a* and a condenser 3*b*, a filter 8 for filtering air, a fan 4 for forced flow of room air, a water tank 6 for collecting dehumidified water. The above various components are mounted inside of a cabinet 1 of the dehumidifier, with a base pan 7 fitted under the cabinet 1, and a discharge grill 9 assembled in front of the cabinet 1. The heat exchanger 3, the fan 4, and the water tank 6 are fitted to the housing 10 on the base pan 7.

The housing 10 will be explained in detail.

The housing 10 includes a barrier part 11 disposed in the cabinet 1 between the compressor 2 and the water tank 6 in a vertical direction, a shroud part 20 extended from the barrier part 11 in a vertical direction having an air flow hole 20*a* with the fan 4 fitted to a center thereof, a motor fixing part 30 projected from the air flow hole 20*a* in the shroud part 20 in a radial direction for fixing the motor 5 of the fan 4, and a drain part 40 formed in a horizontal direction between the barrier part 11 and the shroud part 20 for collecting condensate dropping from the heat exchanger 3 and draining to the water tank 6 under the heat exchanger 3. In the present invention, the barrier part 11, the shroud part 20, the motor fixing part 30, and the drain part 40 are injection molded as one unit.

Respective part of the housing will be explained in more detail. At first, the barrier part 11 will be explained.

Figure 2:
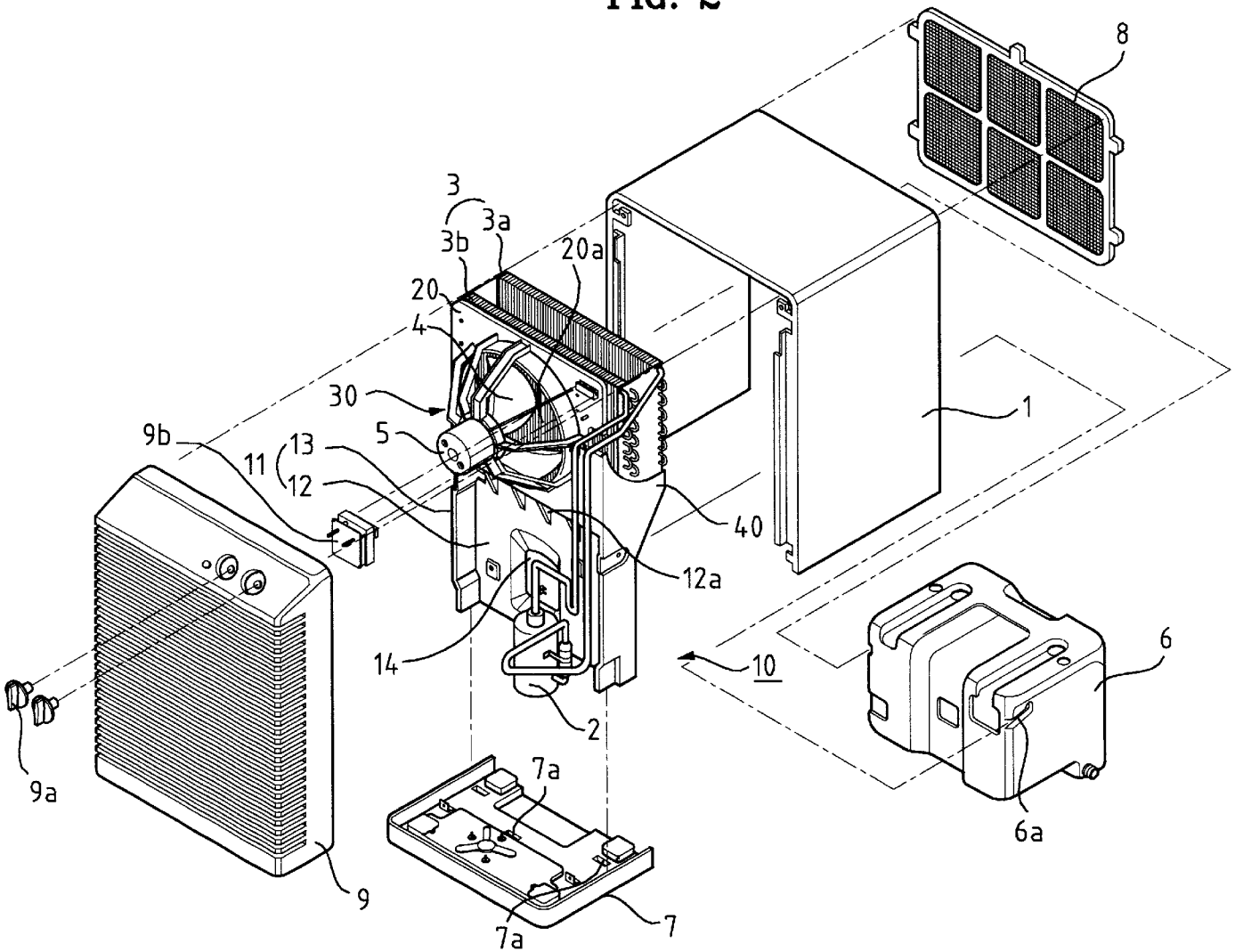
FIG. 2 illustrates a perspective disassembled view of a dehumidifier in accordance with a first preferred embodiment of the present invention.
Figure 3:
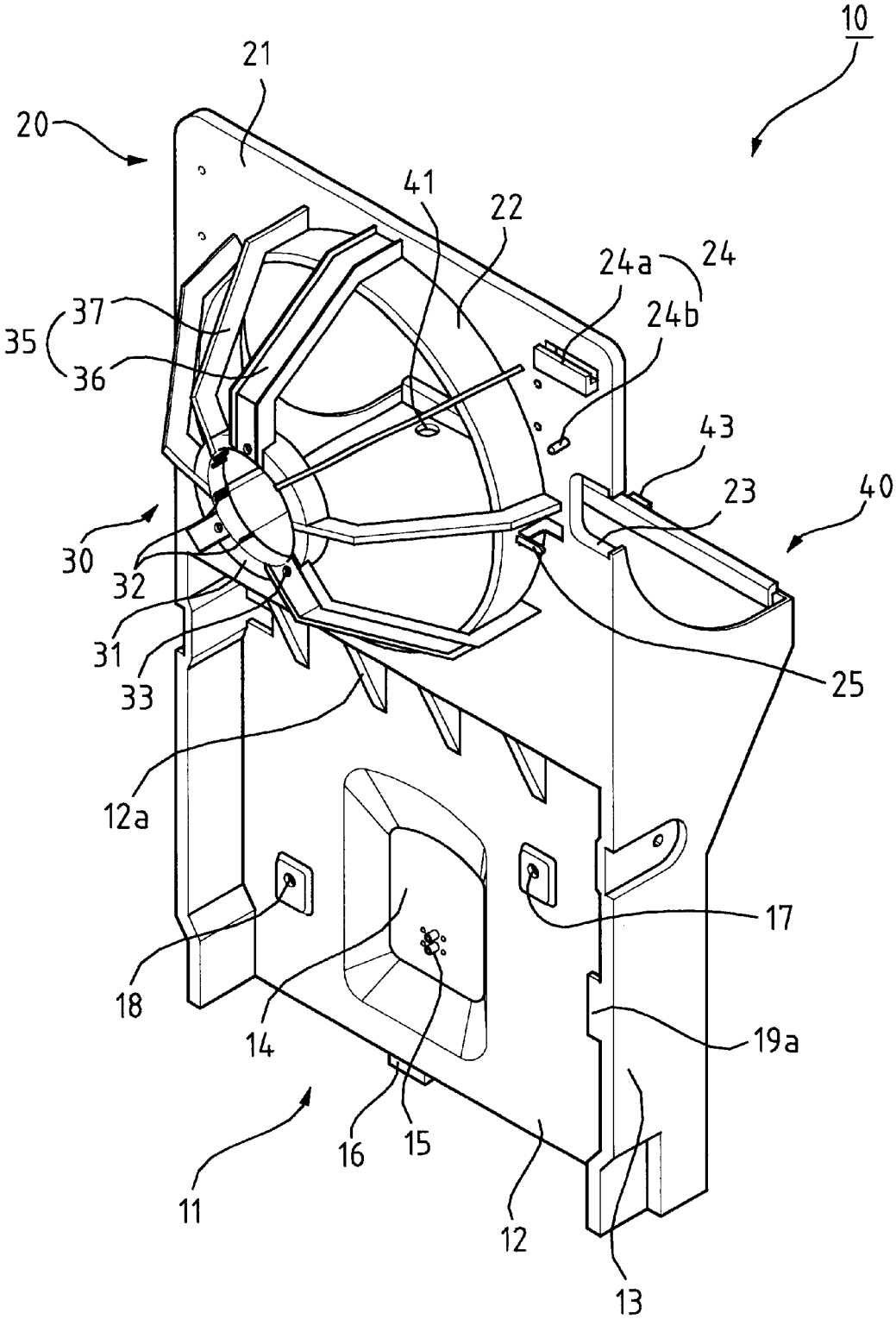
FIG. 3 illustrates a perspective view of a housing of the dehumidifier in FIG. 2.
Figure 4:
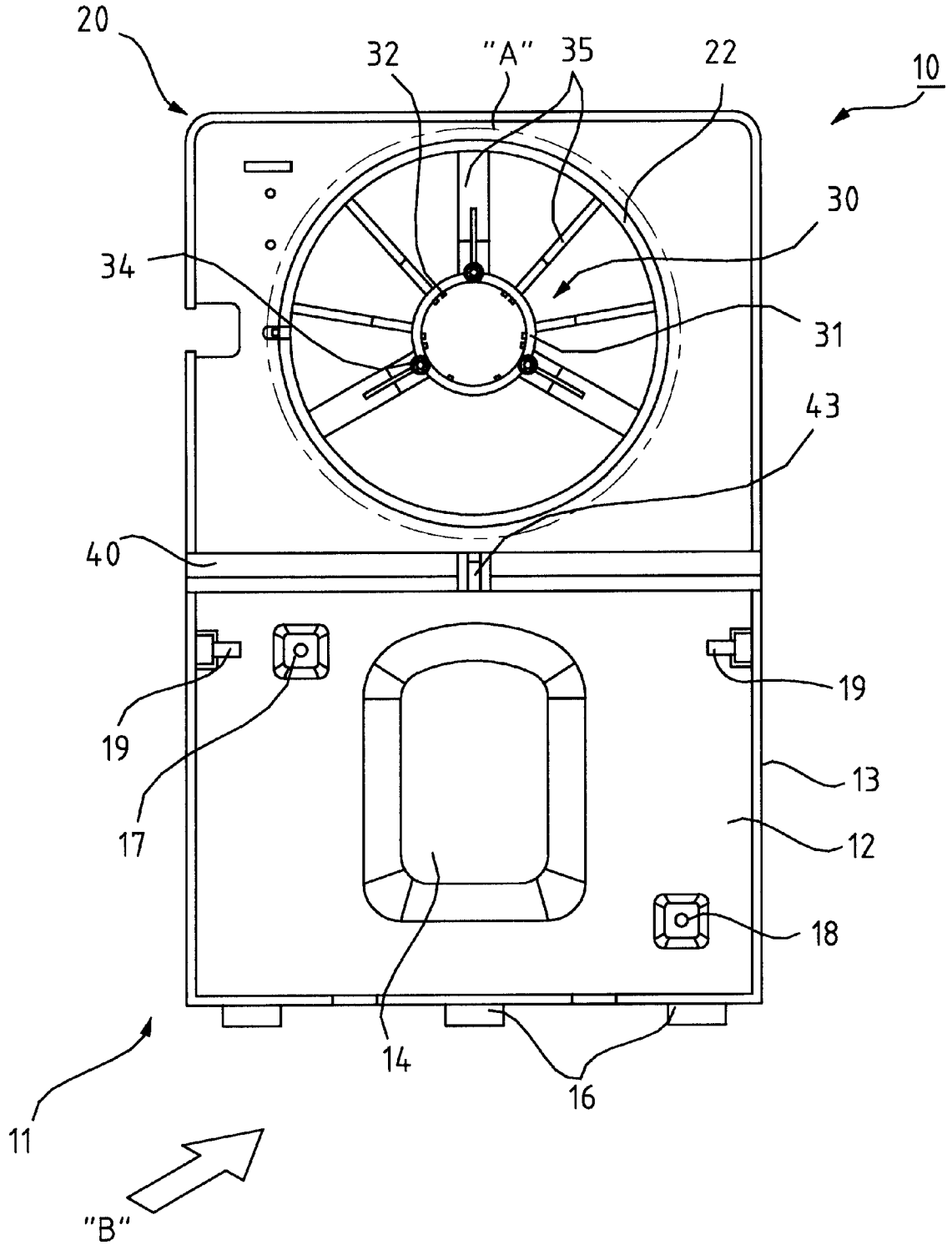
FIG. 4 illustrates a front view of a housing of the dehumidifier in FIG. 3.
Figure 6:
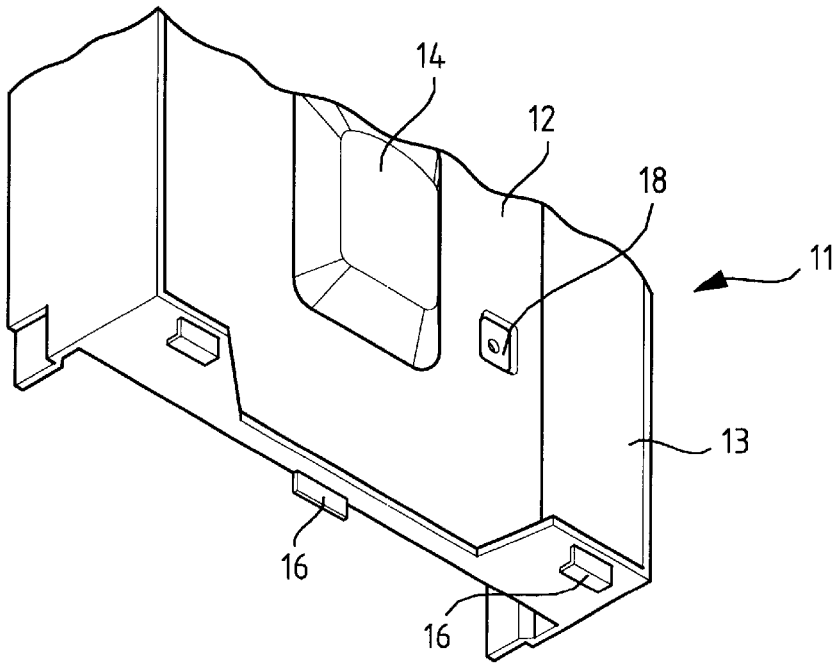
FIG. 6 illustrates a perspective view of a housing seen in a "B" direction in FIG. 4.

The barrier part 11 includes a main wall part 12 provided vertical between the compressor 2 and the water tank 6, and sidewall parts 13 extended from both sides of the main wall part 12 to both sides of the drain part 40. The barrier part 11 supports the heat exchanger 3 and the motor 5, and isolates front and rear spaces of the shroud part 20. There are a plurality of reinforcing ribs 12a for reinforcing a supporting strength against the shroud part 20. The main wall part 12 has a space securing recess 14 recessed from a front face (where the compressor is disposed) to a rear face(where the water tank is disposed) for easy mounting of devices, such as the compressor 2 and other tubes. And, as shown in FIG. 6, the main wall part 12 has a plurality of fastening projections 16 on a bottom face thereof for coupling with the base pan 7. Of course, as shown in FIG. 2, the base pan 7 has recesses 7*a* for inserting the fastening projections 16. Of the fastening projections 16, the fastening projections on both sides thereof are bent in 'λ' forms for inserting into the recesses 7*a* in the base pan 7. And, the main wall part 12 has holes 17 and 18 for fitting a switch to make confirmation of water tank 6 mounting and a switch to make confirmation of full of the water tank 6. In the meantime, as shown in FIG. 4, the main wall part 12 has hanging projections 19 on inside surfaces of the sidewall parts 13, and the water tank 6 has recesses 6*a* in both sides thereof to insert the hanging projections 19 thereto. And, as shown in FIG. 3, the sidewall part 13 has a cable guide part 19*a*.

The shroud part 20 will be explained.

The shroud part 20 includes an annular shroud 22 projected from a circumference of the air flow hole 20*a* in the isolation wall 21. And, there is a tube pass through hole 23 in a side portion of the isolation wall 21 for pass of refrigerant tubes connected from the compressor to the heat exchanger. And, there is a controller fitting part 24 in an upper portion of the tube pass through hole 23 for fitting a controller 9*b* connected to an operation switch 9*a* fitted to top of the discharge grill 9. The controller fitting part 24 has a hanging part 24*a* formed relatively high portion for hanging a controller 9*b*, and a projection 24*b* formed in a lower portion of the hanging part 24*a* for supporting the controller 9*b* to prevent movement of the controller 9*b*. And, the shroud 22 has a cable guide projection 25 on a front surface thereof for guiding the cable connected to the controller 9*b*.

Next, the motor fixing part 30 will be explained.

Figure 5:
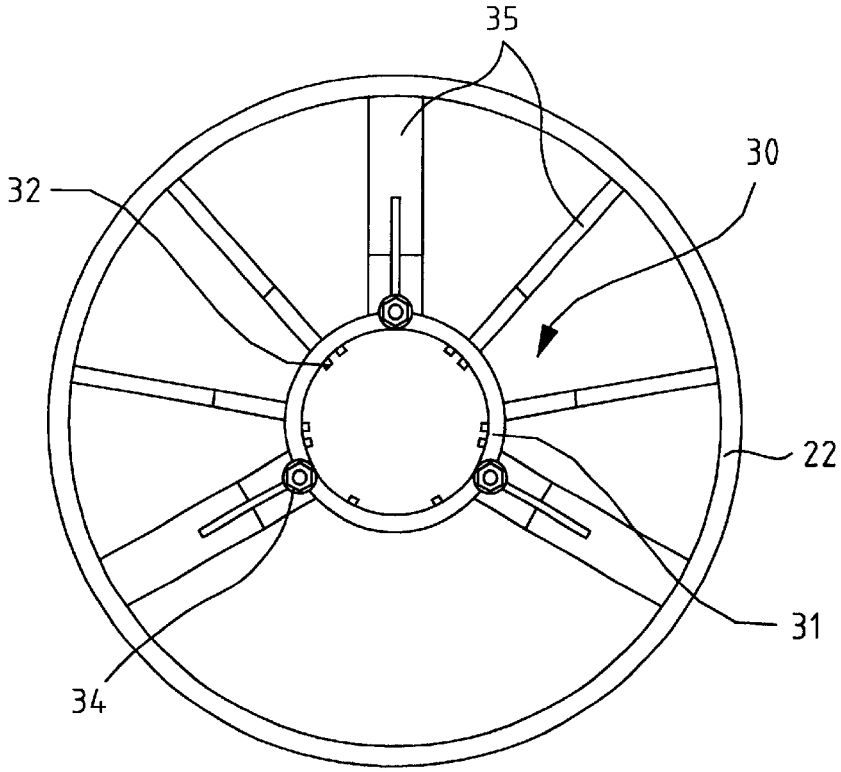
FIG. 5 illustrates an enlarged front view of"A" part in FIG. 4.

The motor fixing part 30 includes a motor fastener 31 formed in a ring form in front of the shroud part 20 for fastening the motor 5 thereto, and supporting members 35 connected from the motor fastener 31 to the shroud 22 of the shroud part 20 in a radial form. There are a plurality of ribs 32 projected from an inside circumference of the motor fastener 31, for maintaining a gap between the motor 5 and the motor fastener 31, to prevent a heat generated during operation of the motor 5 from transmission toward the motor fastener 31, which is formed by injection molding, as it is, and secure a heat dissipation space of the motor. The supporting member 35 has main supporting members 36 formed at 120° intervals from the motor fastener 31 to the shroud part, and a plurality of supplementary supporting members 37 formed between the main supporting members 36 for maintaining a concentricity of the motor fastener 31 and reinforcing a supporting strength. The main supporting members 36 are formed to have an adequate rigidity for supporting the fan 4 and the motor 4, and the supplementary supporting members 37 are formed to be parallel to a flow direction of the air so as to have the least contact area with a flowing air for minimizing a resistance to the air discharged from the fan 4. The motor fixing part 30 has a plurality of screw holes 33 for fastening the motor 5 with bolts or screws. In this instance, as shown in FIGS. 4 and 5, the screw hole 33 has a nut recess 34 of a regular bolt head form, to cope with a case when the screw hole 33 is worn down owing to frequent screwing for taking out and repair of the motor, when a bolt or nut is inserted in the nut recess 34 and fasten it. According to the present invention, because the motor 5 is firmly mounted on the motor fixing part 30 by the plurality of supporting members 35, and the fan 4 is supported by the firmly mounted motor 5, the vibration generated during operation of the fan 4 and motor 5 can be reduced.

Next, the drain part 40 will be explained.

The drain part 40 is formed to receive the condensate, and includes a condensate drain hole 41 in communication with the water tank 6 in one side portion thereof, and a filter fastening part 43 projected from a rear portion thereof for supporting a bottom of the filter 8.

The operation of the foregoing dehumidifier of the present invention will be explained.

When the compressor 2 and the fan 4 are put into operation, room air is forced to flow toward the discharge grill 9 from the filter 8, when the heat exchanger 3 having the evaporator 3*a* and the condenser 3*b* dehumidifies, to control a humidity of the room air. The condensate formed by the dehumidification of the heat exchanger 3 drops onto the drain part 40, drains into the water tank 6 through the drain hole 41, and stored in the water tank 6.

The aforementioned dehumidifier of the present invention has the following advantages.

First, the formation of a plurality of assembly structures as one unit for supporting the heat exchanger and the fan permits to reduce assembly components, that improves productivity and saves cost. The formation of the shroud part, the fan and the motor supported on the one unit and the drain part of the heat exchanger also supported on the one unit above the barrier part significantly enhances the strength. Support for components is improved and the assembly is simplified as the unit does not have to be loosened even after a prolonged use.

Second, the perfect isolation of a front space and a rear space inside of the dehumidifier owing to formation of the barrier part and the shroud part as one unit in the housing of the present invention can enhance a dehumidifying capability as the air passed through the heat exchanger and the fan is flow, not in a reverse direction to a space of the heat exchangers again, but discharged through the discharge grill as it is, thereby enhancing the dehumidifying capability. That is, since the formation of the housing of the present invention with almost no gaps permits to prevent flow loss liable to occur during heat exchanging, the dehumidifying capability can be enhanced.

Third, the sliding in type mounting structure of the water tank into the barrier part permits an easy mounting of the water tank at an exact position.

In the meantime, the first embodiment shows formation of the barrier part 11, the shroud part 20, the motor fixing part 30, and the drain part 40 formed as a unit. However, the present invention is not limited to this. That is, either the barrier part 11, the shroud part 20, and the motor fixing part 30 only may be formed as one unit, or the shroud part 20, the motor fixing part 30, and the drain part 40 only may be formed as one unit.

A dehumidifier housing in accordance with a second preferred embodiment of the present invention will be explained with reference to FIGS. 7~11.

Though the barrier part, the shroud part, the motor fixing part, and the drain part are formed as one unit in the first preferred embodiment of the present invention, in this second preferred embodiment of the present invention, the barrier part and the drain part are formed as one unit as a lower housing 300, and the shroud part and the motor fixing part are formed as one unit as an upper housing 200. And, the upper housing 200 and the lower housing 300 are coupled. And, an axial fan is used in the first embodiment, a turbo fan 104 is used in the second embodiment.

The lower housing 300 and the upper housing 200 will be explained in detail, respectively.

Figure 8:
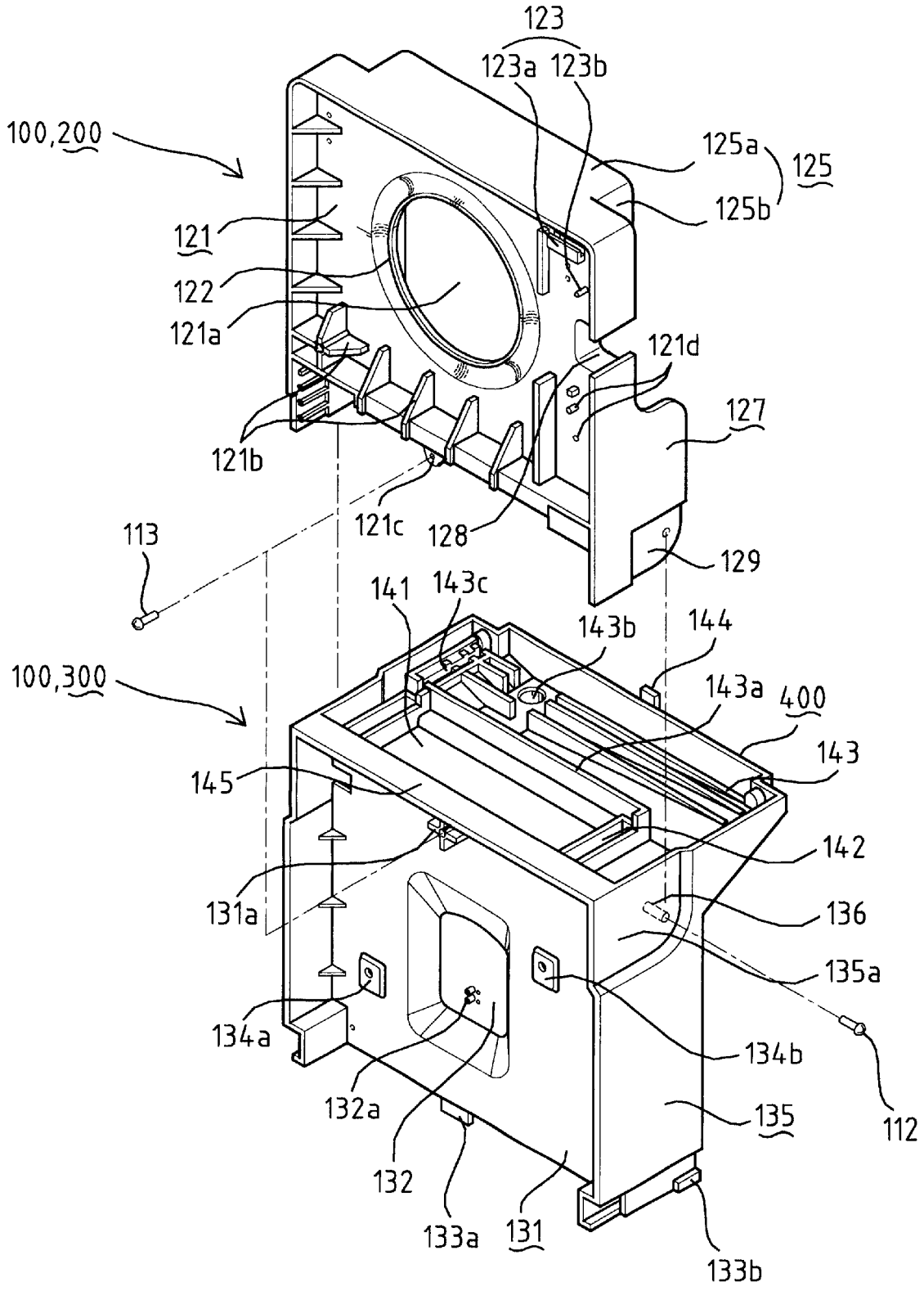
FIG. 8 illustrates a perspective disassembled view of a housing of the dehumidifier in FIG. 7.
Figure 9:
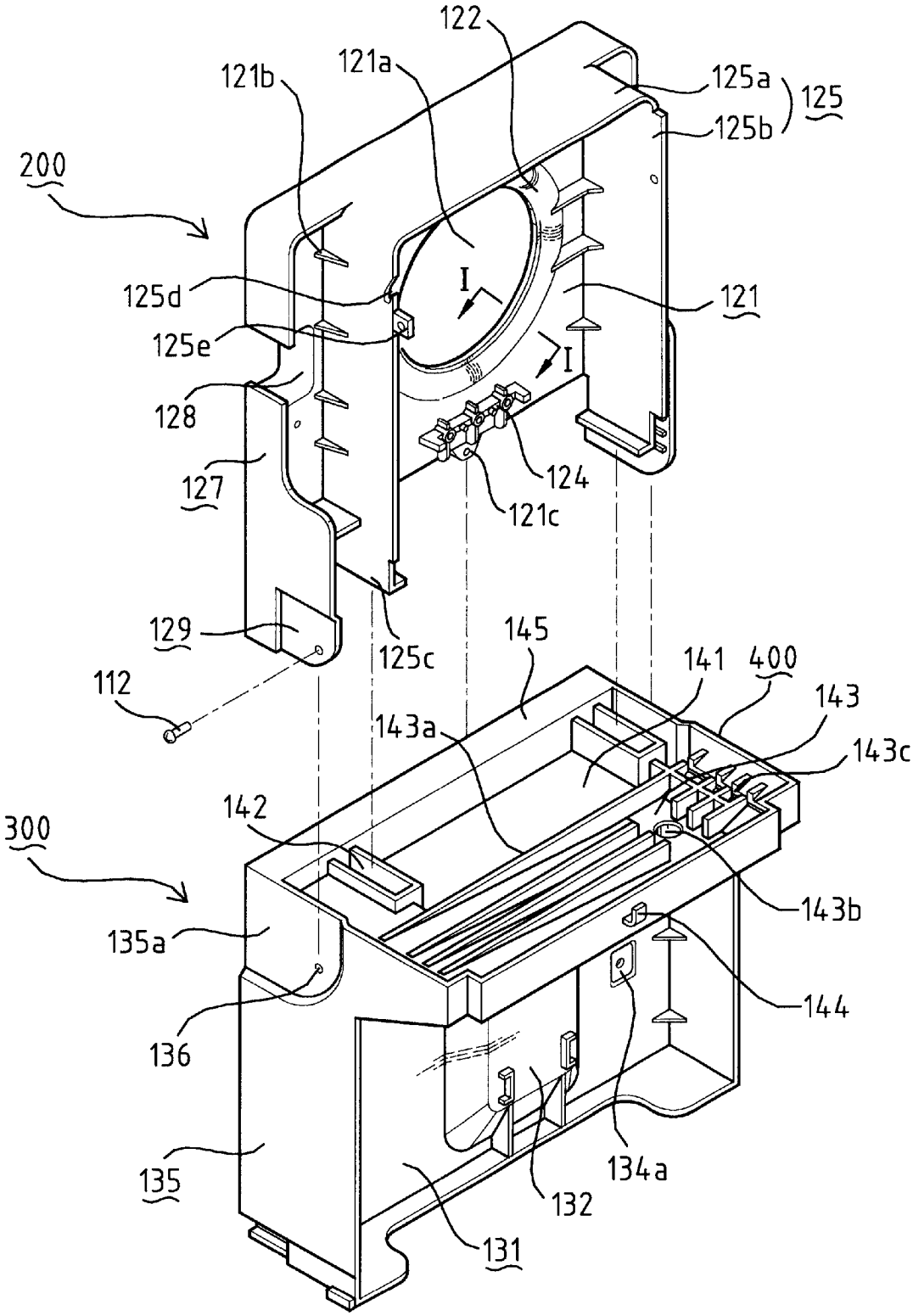
FIG. 9 illustrates a perspective disassembled view of a housing of the dehumidifier in FIG. 8 seen in an opposite side.
Figure 10:
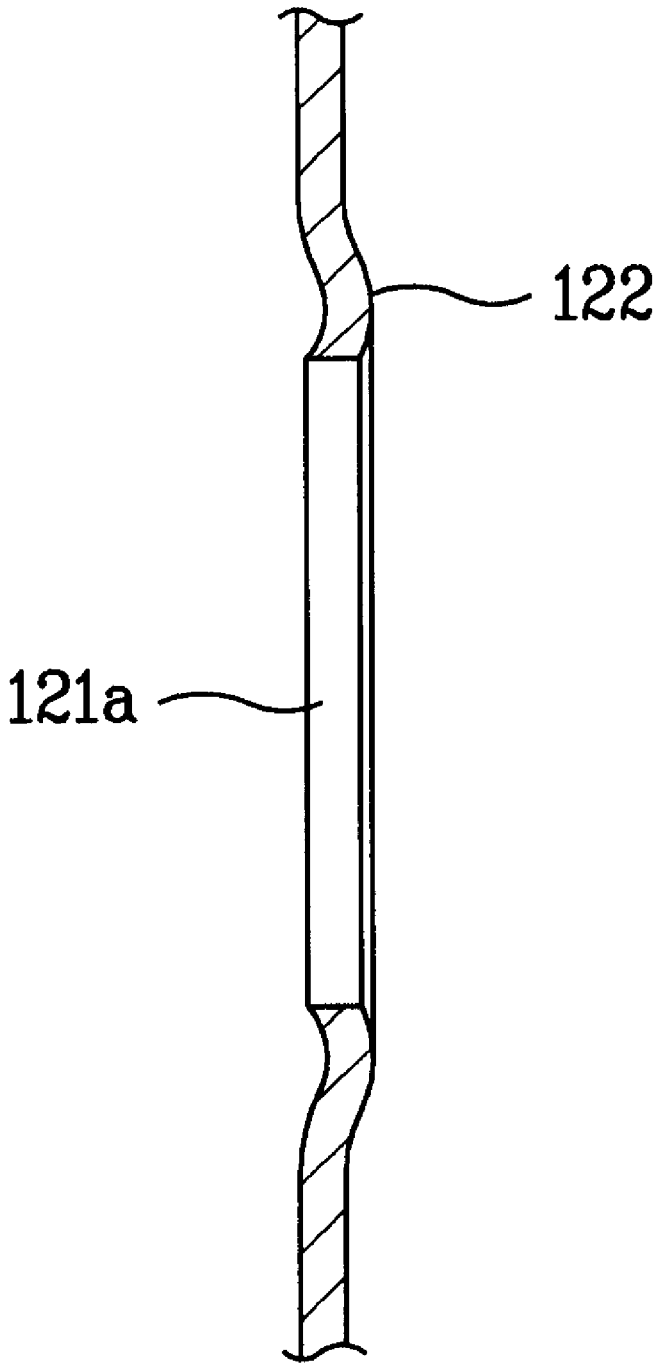
FIG. 10 illustrates a section across 14 line in FIG. 9.

The upper housing 200 has barrier assembly parts 129 at bottom portions of both side rim parts 127, and a guide part 125 has a guide extension at a bottom. And, the lower housing 300 has relatively recessed setting parts 135*a* in upper portions of sidewalls 135 for setting the barrier assembly parts 129, and guide inserting parts 142 in a top surface of the drain part 400 for insertion of the guide extensions 125*c*. That is, the guide extension 125*c* has a horizontal bent at an end thereof, and the guide insertion part 142 has a projection of a rectangular rim from the top surface of the drain part 400 for insertion of the end part of the guide extension 142. In the meantime, as shown in FIG. 8, the lower housing 300 has a hanger part 136 projected from the sidewall 135 for hanging the recess 6*a* in the water tank 6, wherein it is preferable that a hole is formed in the hanger part 136 for a fastening screw 112 to fasten the barrier assembly part 129 and the sidewall 135. In the meantime, as shown in FIGS. 8 and 9, there is a screw fastening part 121*c* in a lower portion of an orifice part 121 of the upper housing 200, and an orifice fastening part 131*a* in an upper portion of the barrier part 131 of the lower housing 300 for fastening the screw 113 to the screw fastening part 121*c*. Eventually, the upper housing 200 and the lower housing 300 are assembled as the barrier assembly parts 129 and the screw fastening part 121*c* of the upper housing 200 are assembled to the sidewalls 135 and the orifice fastening part 131*a* of the lower housing 300 with the screws 112 and 113, and the guide extensions 125*c* of the upper housing 200 are set to the guide insertion parts 142 of the drain part 400.

The foregoing upper housing 300 and the lower housing 200 will be explained, in more detail.

Figure 7:
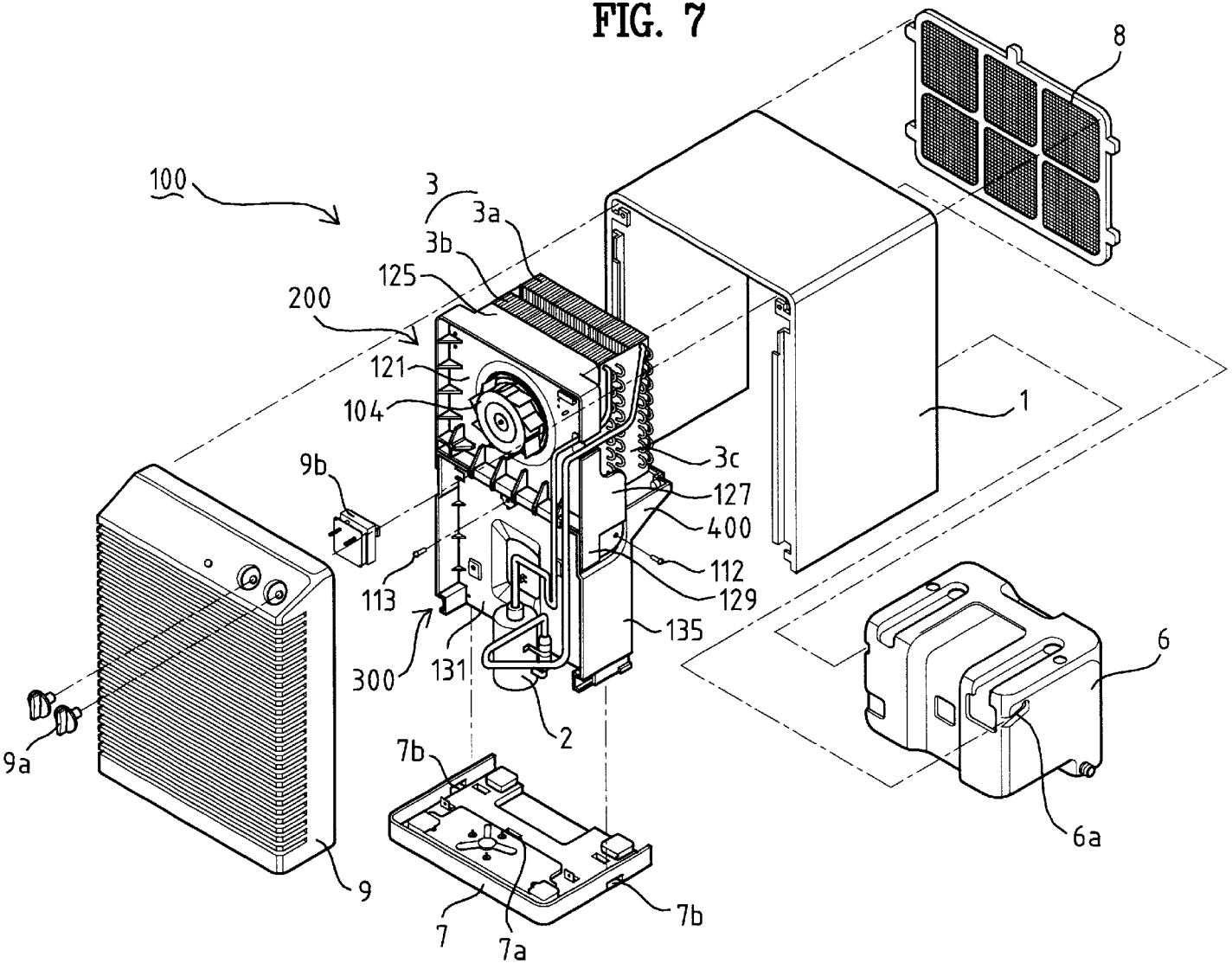
FIG. 7 illustrates a perspective disassembled view of a dehumidifier in accordance with a second preferred embodiment of the present invention.

First, the barrier part 131 in the lower housing 300 is vertically fitted between the compressor 2 and the water tank 6 for supporting the heat exchanger 3 and the motor 104*a* and isolating the front space and the rear space of the dehumidifier together with the upper housing 200. And, as shown in FIG. 8, the barrier part 131 has a plurality of fixing projections 133*a* and 133*b* in a lower portion for fixing to a top portion of the base pan 7. Of course, as shown in FIG. 7, the base pan 7 has recesses 7*a* and 7*b* for inserting the fixing projections 133*a* and 133*b*. And, there are hanger parts 136 projected from opposite sides of inside of the sidewalls 135, and recesses 6*a* on both sides of the water tank 6 for insertion in the hanger parts 136. And, similar to the first embodiment, the barrier part 131 has a space securing recessed part 132, and holes 134*a* and 134*b* for use in confirmation of mounted water tank 6 and fitting full water confirming switches.

Referring to FIG. 9, the drain part 400 includes a guide forming part 141 for coupling with the guide part 125 of the upper housing 200 and forming a lower portion of an air flow passage, a drain passage 143 under the heat exchanger 3 formed by the guide forming part 141 and an isolation wall 43*a*, and an orifice coupling part 145, a flat portion, projected upward from a front portion of the guide forming part 141 for close fitting of the bottom of the orifice part 121 of the upper housing 200. There is a condensate discharge hole 143*b* at one side of the drain passage 143 in communication with the water tank 6, and a filter fixing part 144 at a rear portion of the drain passage 143 for supporting a bottom of the filter 8. And, there are channel inserting parts 143*c* on both sides of the drain passage part 143 for inserting channels 3*c* of the heat exchanger 3.

Next, the upper housing 200 will be explained in more detail.

Referring to FIGS. 7 and 8, portions of the orifice part 121 and the rim part 127 of the upper housing 200 are cut away to form a tube passage 128 for passing refrigerant tube connected from the compressor 2 to the heat exchanger 3. And, there is a controller fitting part 123 above the tube passage 128 for fitting a controller 9*b* connected to an external operation switch 9*a*. The controller fitting part 123 has a hanging part 123*a* formed relatively higher for hanging the controller 9*b*, and a movement prevention projection 123*b* below the hanging part 123*a* for supporting the controller 9*b*. And, there is a clamp fixing part 121*d* for guiding cables connected to the fan and the motor.

Figure 11:
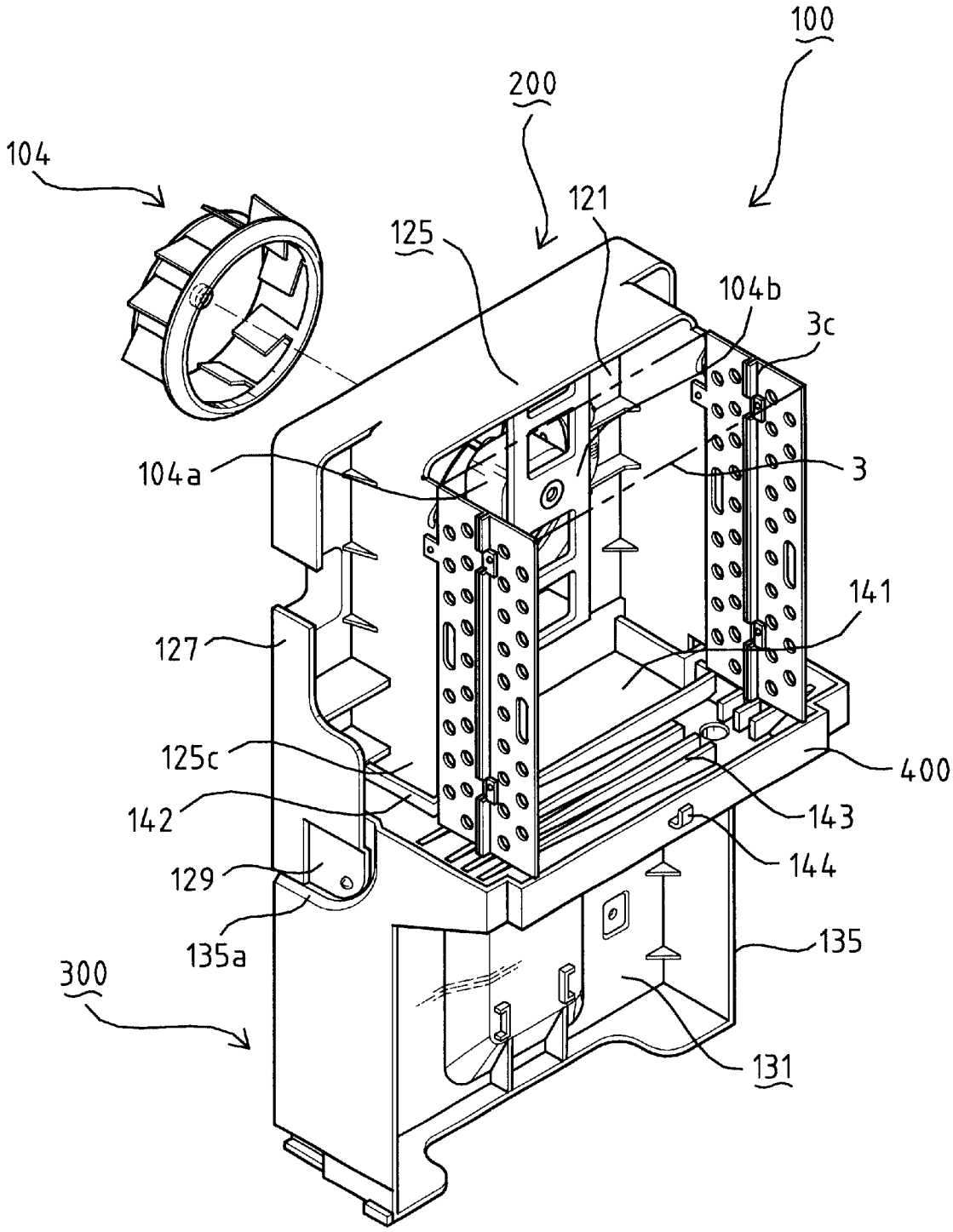
FIG. 11 a perspective view of the housing in FIG. 7 having the heat exchanger and the turbo fan mounted therein.

And, referring to FIGS. 9 and 11, there are mounter fixing parts 124 in upper and lower portions of a rear face of the orifice part 121 for fixing the motor mounter 104*b* to mount the motor 104*a* driving the turbo fan 104. And, as shown in FIG. 8, there are a plurality of reinforcing ribs 121*b* at a corner part where the orifice part 121, the guide part 125 and the rim part 127 meet.

In the meantime, the turbo fan 104 is mounted in the air flow hole 121*a* of the upper housing 200. There is an annular guide 122 around the air flow hole 121*a* projected in a direction of the heat exchanger 3 for guiding the air flow toward the turbo fan 104. And, the guide part 125 has a cable slot 125*d* at one side for inserting and fixing a cable connected to the motor 104*a* driving the turbo fan 104.

In the meantime, as shown in FIG. 11, a circumference of the guide part 125 is formed to have a size the same with a size of a circumference of the heat exchanger 3 for close contact of the circumference of the heat exchanger 3 to the circumference of the guide part 125 in mounting the heat exchanger 3. And, the guide part 125 has a plurality of fixing parts 125*e* for fixing the channels 3*c* of the heat exchanger 3.

As the operation of the second embodiment dehumidifier is similar to the first embodiment, a detailed explanation thereof will be omitted. And, advantages of the dehumidifier housing of the present invention will be explained.

The stable mounting of the upper housing 200 the turbo fan 104, the motor 104*a*, and the heat exchanger 3 are supported thereon on the lower housing 300 having the barrier part 131 and the drain part 400 permits to enhance a rigidity. And, the prevention of reverse flow of air passed through the heat exchanger 3 and the turbo fan 104 toward a heat exchanger 4 space again owing to an efficient isolation of the front space and the rear space in the dehumidifier permits to enhance a dehumidifying capability. Especially, the formation of the annular guide 122 on the orifice part 121 of the upper housing 200 and formation of the guide part 125 for tight sealing between the heat exchanger 3 and the orifice part 121 permits no loss of the dehumidified air, but total discharge toward the discharge grill 9 through the air flow hole 121*a*, thereby enhancing the dehumidifying effect, further.

The handy mounting of the water tank 6 at an exact position is made possible as the water tank 6 is inserted inside of the sidewalls 135 in the mounting, and the fastening of the screw 112 for fixing the upper housing 200 to the hanger part 136 on the sidewalls 135 improves a supporting rigidity.

It will be apparent to those skilled in the art that various modifications and variations can be made in the dehumidifier housing of the present invention without departing from the spirit or scope of the invention. Thus, it is intended that the present invention cover the modifications and variations of this invention provided they come within the scope of the appended claims and their equivalents.

What is claimed is:

1. A dehumidifier housing comprising:

a cabinet having an inside;

a lower housing including a barrier part fitted vertically between a compressor section and a water tank section within the inside of the cabinet, a drain part formed in a horizontal direction above the barrier part for collecting condensate dehumidified at a heat exchanger section and for draining the water tank section, and sidewalls formed at both sides of the barrier part and the drain part portion in a front and rear direction and positioned along the inside of the cabinet;

an upper housing including an orifice part having an air flow hole in a central portion, and a rim part around the orifice part in front and rear direction, said orifice part being positioned within the inside of the cabinet; and means for coupling the lower housing and the upper housing.

2. The dehumidifier housing as claimed in claim 1, wherein the upper housing further includes guide parts projecting from an inside of the rim part toward the heat exchanger for guiding flow of dehumidifying air passed through the heat exchanger.

3. The dehumidifier housing as claimed in claim 2, wherein said means for coupling includes a setting part formed recessed at an upper portion of sidewalls of the lower housing, and a barrier assembly part extending from a bottom of the rim part of the upper housing.

4. The dehumidifier housing as claimed in claim 3, wherein the guide part of the upper housing includes a downward guide extension below the guide part, and the drain part of the lower housing includes a guide insertion part for inserting the guide extension thereto.

5. The dehumidifier housing as claimed in claim 2, wherein the sidewall of the lower housing includes a hanger part projected from an inside surface thereof for hanging the water tank, and the hanger part has a hole for inserting a screw for fastening the barrier assembly part and the setting part.

6. The dehumidifier housing as claimed in claim 2, wherein the drain part includes a guide forming part for coupling the guide part of the upper housing and forming a lower portion of an air flow passage, and a drain passage under the heat exchanger separated from the guide forming part by the isolation wall.

7. The dehumidifier housing as claimed in claim 6, further comprising channel inserting parts on both sides of the drain passage for inserting both side channels of the heat exchanger.

8. The dehumidifier housing as claimed in claim 2, further comprising a turbo fan mounted in the air flow hole in the upper housing.

9. The dehumidifier housing as claimed in claim 8, wherein there is an annular guide around the air flow hole of the orifice part projected toward the heat exchanger for guiding air flow toward the turbo fan.

10. The dehumidifier housing as claimed in claim 9, wherein there are mounter fixing parts on upper and lower sides of the air flow hole for fixing the motor mounter to mount the motor driving the turbo fan.

11. A dehumidifier housing comprising:

a cabinet having an inside;

a lower housing including a barrier part fitted vertically between a compressor section and a water tank section within the inside of the cabinet, and a drain part formed on an upper portion of the barrier part in a horizontal direction for collecting condensate dropped from a heat exchanger section and draining to the water tank section; and an upper housing including a shroud part extending from the upper portion of the barrier part in a vertical direction and having an air flow hole at a central portion thereof for mounting a fan, and a motor fixing part projected from the air flow hole in the shroud part in a radial form for fixing a motor of the fan thereto, wherein the upper housing and the lower housing are formed as one unit.

12. The dehumidifier housing as claimed in claim 11, wherein the barrier part further includes a main wall part fitted vertically between the compressor section and the water tank section, and sidewalls extended from both sides of the main wall to both sides of the drain part.

13. The dehumidifier housing as claimed in claim 12, wherein the shroud part includes an annular shroud projected from a circumference of the air flow hole.

14. The dehumidifier housing as claimed in claim 13, wherein the motor fixing part includes;

a ring formed motor fastener, and supporting members connected from the motor fastener to the shroud part in a radial form.

15. The dehumidifier housing as claimed in claim 14, wherein the motor fastener includes a plurality of ribs formed on an inside circumference of the motor fastener for maintaining a gap between the motor and the motor fastener.

16. A dehumidifier comprising:

a compressor;

a heat exchanger;

a fan and a motor;

a water tank;

a cabinet having an interior, said compressor, said heat exchanger, said fan and said motor and said water tank being positioned within the interior of the cabinet; a lower dehumidifier housing including a barrier portion fitted vertically between a compressor and the water tank within the interior of the cabinet, and a drain part formed on an upper portion of the barrier part in a horizontal direction for collecting condensate falling from the heat exchanger and draining to the water tank; and an upper housing including a shroud part extending from the upper portion of the barrier part in a vertical direction and having an air flow hole at a central portion thereof mounting the fan, and a motor fixing part projected from the air flow hole in the shroud part in a radial form and fixing the motor of the fan thereto, wherein the upper housing and the lower housing are formed as one-piece, molded unit.

* * * * *